US005391859A

United States Patent [19]

Hazan et al.

[11] Patent Number: 5,391,859

[45] Date of Patent: Feb. 21, 1995

[54] IRON COMPRISING HUMIDITY RESPONSIVE MOTION DETECTOR AND ELECTROSTATIC CHARGE DETECTOR FOR CONTROLLING THE HEATING ELEMENT

[75] Inventors: Jean-Pierre Hazan, Sucy En Brie; Rémy Polaert, Villecresnes; Jean-Louis Nagel, Limeil Brevannes, all of France

[73] Assignee: U.S. Philips Corporation, New York, N.Y.

[21] Appl. No.: 915,800

[22] Filed: Jul. 16, 1992

[30] Foreign Application Priority Data

Jul. 19, 1991 [FR] France ..... 91 09133

[51] Int. Cl.[6] ..... D06F 75/26; G01D 5/24

[52] U.S. Cl. ..... 219/250; 38/82; 38/75; 361/280

[58] Field of Search ..... 38/69, 75, 77.1–77.83, 38/82, 1 C; 219/245–259, 509; 324/61 R; 361/280

[56] References Cited

U.S. PATENT DOCUMENTS

| | | | |
|---|---|---|---|
| 2,313,917 | 3/1943 | Brownlee | 38/1 C |
| 2,313,918 | 3/1943 | Brownlee | 38/1 C |
| 2,395,787 | 2/1946 | Ledbetter et al. . | |
| 4,311,958 | 1/1982 | Aeppli | 324/61 R |

FOREIGN PATENT DOCUMENTS

| | | |
|---|---|---|
| 0222484 | 5/1987 | European Pat. Off. . |
| 3444348 | 6/1986 | Germany . |

*Primary Examiner*—Bruce A. Reynolds
*Assistant Examiner*—John A. Jeffery
*Attorney, Agent, or Firm*—Ernestine C. Bartlett

[57] ABSTRACT

An iron comprises a heating element (97), heating-control (96) for the heating element (97), and a motion detector. The motion detector can be an electrostatic detector (35) which determines an amount of electrostatic charges present at the fabric. The motion detector can be a humidity detector (60) which detects a resistivity of the fabric between two electrodes (62$_a$, 62$_b$) which are in contact with the fabric. A counting circuit (89) calculates a number of halfwaves of an electric signal supplied by one of the detectors and determines whether the iron is in use or is not in use. Moreover, the degree of humidity of the fabric can be determined by a measurement circuit (99).

20 Claims, 3 Drawing Sheets

IRON COMPRISING HUMIDITY RESPONSIVE MOTION DETECTOR AND ELECTROSTATIC CHARGE DETECTOR FOR CONTROLLING THE HEATING ELEMENT

FIELD OF THE INVENTION

The invention relates to an iron comprising a hearing element, heating-control means for the heating element, and a motion detector.

When an iron in its energized condition is left standing on a fabric this may give rise to certain problems. The fabric may be damaged depending on the temperatures reached. Therefore, it is useful to provide the iron with a safety device which turns off the iron when it is not in use. This is generally effected by detecting the movement of the iron by means of a motion detector.

BACKGROUND OF THE INVENTION

Such a detector is described in, for example, Patent (Europe). Said detector comprises a magnet arranged at the end of a swing lever, which oscillates with the movement impressed upon the iron by the user. An electric signal generated by this movement makes it possible to detect when the iron is in use and, consequently, when it is not in use. However, such a device is found to be difficult to realize in mass production. Moreover, the swing lever moves substantially in a plane of oscillation parallel to the axis of movement of the iron, which axis extends in the direction of the tip of the soleplate of the iron. A movement perpendicular to this plane of oscillation is then not detected. Moreover, the presence of moving elements also constitutes a drawback.

SUMMARY OF THE INVENTION

It is an object of the invention to provide a movement detector for an iron which can be manufactured more easily in mass production and which does not comprise any moving parts and is thus of a simple construction.

This object is achieved by means of a motion detector constituted by an electrostatic detector comprising:

means for picking up electrostatic charges produced by a movement of the iron on a fabric, and means for detecting the movement of the iron by measuring a rhythm of an electric signal resulting from variations of the electrostatic charges.

In accordance with the invention the amount of the electrostatic charges generated at the surface of the fabric is measured by the movement of the iron on the fabric. It is then possible to detect variations in the amount of the electrostatic charges, which variations are dictated by the movement.

Suitably, the sensitivity of the detector can be increased by arranging in the proximity of the detector a plate of an insulating material which generates electrostatic charges at the surface of the fabric by frictional contact with the fabric.

Thus, the iron may comprise an element made of an electrically insulating material and arranged on the iron to generate electrostatic charges by frictional contact as the iron slides on the fabric.

The insulating material may be, for example a material available commercially under the trademark, Teflon*, glass, enamel, Kapton.

Such an electrostatic detector is mainly intended for use in ironing dry fabrics. When the fabric is damp the ability of a fabric to store electrostatic charges decreases. This means that the efficiency of the electrostatic detector decreases as the humidity of the fabric increases.

To enable the movement of the iron to be detected even in the case of damp fabrics a humidity detector is added to the electrostatic detector, which humidity detector supplies an electric signal when the fabric is damp and comprises:

means for measuring a resistivity of the fabric, and means for detecting the movement of the iron by measuring a rhythm of another electric signal resulting from resistivity variations caused by the movement of the iron on the fabric.

The passage of the iron through zones which generally do not have the same humidity enables the humidity detector to supply an electric signal which varies depending on the position of the iron on the fabric. These variations are employed to detect the movement of the iron on damp fabrics.

The means for measuring the resistivity comprise at least one electrode, which is flush with the soleplate of the iron to enable it to be brought into contact with the fabric.

BRIEF DESCRIPTION OF THE DRAWINGS

The invention will be more fully understood by means of the following drawings, which are given by way of non-limitative example and in which.

DESCRIPTION OF EMBODIMENTS

Figure 1:
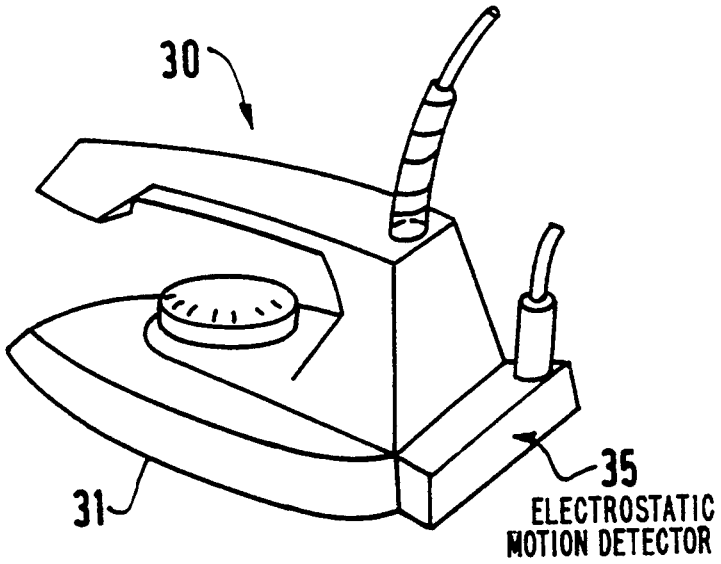
FIG. 1 is a perspective view of an example of an iron provided with an electrostatic detector.

The electrostatic detector is arranged in the iron in such a way that it is faces the fabric when the iron is moved over the fabric. FIG. 1 shows diagrammatically an iron 30 provided with an electrostatic detector 35 arranged at the back of the soleplate 31 of the iron.

Figure 2A:
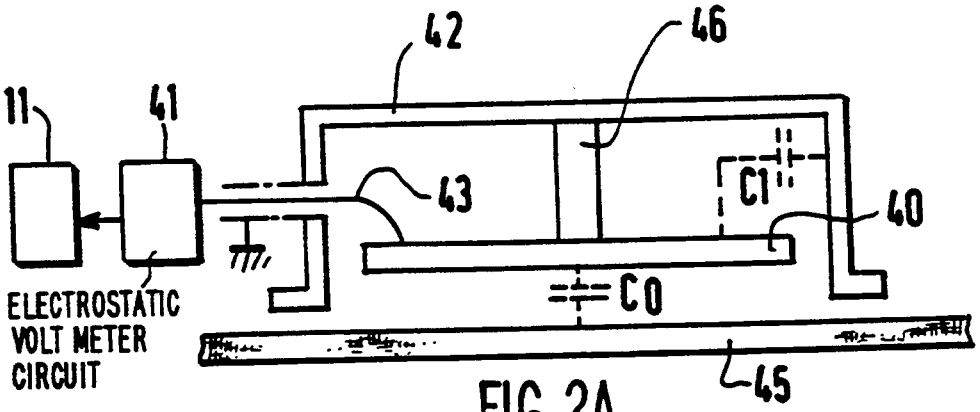
FIG. 2A shows a diagram of an electrostatic detector which operates by measuring electrostatic charges.

The electrostatic detector is shown in FIG. 2A which shows a metal electrode 40 which is electrically connected to a high-impedance electrostatic voltmeter circuit 41. The electrode 40, which is electrically insulated by means of an insulator tube 46, is arranged in a shielding 42 in order to ensure that the measurement is not disturbed. A coaxial connection 43 may be provided between the electrode 40 and the voltmeter circuit 41.

The electrode 40 is arranged in the iron so as to be situated at a small distance from the fabric 45. Thus, the amount of the electrostatic charge generated at the surface of the fabric by the movement of the soleplate of the iron can be measured capacitively by means of the electrode 40. Between the electrode 40 and the fabric 45 a capacitance $C_0$ exists. Between the electrode 40 and the shielding 42 a capacitance $C_1$ exists.

The electric signal appears as a signal whose amplitude varies in the rhythm of the movement of the iron on the fabric.

In order to avoid that the electrostatic charges accumulate to the extent that they saturate the input stage of the electrostatic voltmeter circuit 41, which would prevent signal fluctuations from being measured, it is possible to carry out zero resets. For this purpose there is provided a predetermined electrostatic-charge threshold which should not be exceeded. When this threshold is reached the electrode 40 should be reset to zero:

automatically, or or by arranging a permanent leakage resistance across the capacitance $C_1$, or by cyclically short-circuiting the electrode 40.

Figure 2B:
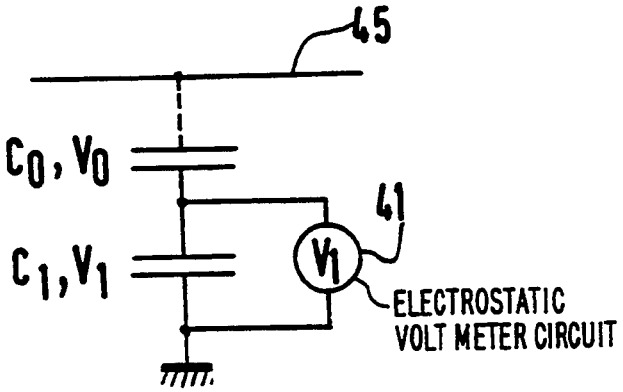
FIG. 2B shows a capacitive bridge of the electrostatic detector.

The capacitive bridge is shown in FIG. 2B. By measuring the electrostatic potential $V_1$ across the capacitance $C_1$ it is possible to determine the magnitude of the charges on the fabric. By measuring $V_1$, the values $C_0$ and $C_1$ being laid down by the construction, it is possible to determine the electrostatic character of the fabric by experiment. By way of example comparative values (expressed in arbitrary units) are given for several fabric types.

| | |
|---|---|
| Cotton | 1 to 5 |
| Viscose | 1 to 5 |
| Acetate | 15 to 20 |
| Polyester | 18 to 24 |
| Acrylic | 15 to 20 |
| Nylon | 14 to 18 |
| Wool | 18 to 24 |
| Silk | 14 to 20 |

It is to be noted that most fabrics requiting comparatively low ironing temperatures exhibit the most pronounced electrostatic character.

It is possible to increase the amount of generated electrostatic charges by providing the iron with an element made of an insulating material and arranged on the iron to generate electrostatic charges by frictional contact as the iron slides on the fabric. It may be formed by, for example, a plate 64 (FIG. 3) arranged in the proximity of the electrostatic detector 35. The plate 64 may partly or wholly surround the electrostatic detector and have an L-shape or a circular shape. The plate can be made of, for example, Teflon, glass, enamel, Kapton.

Figure 3:
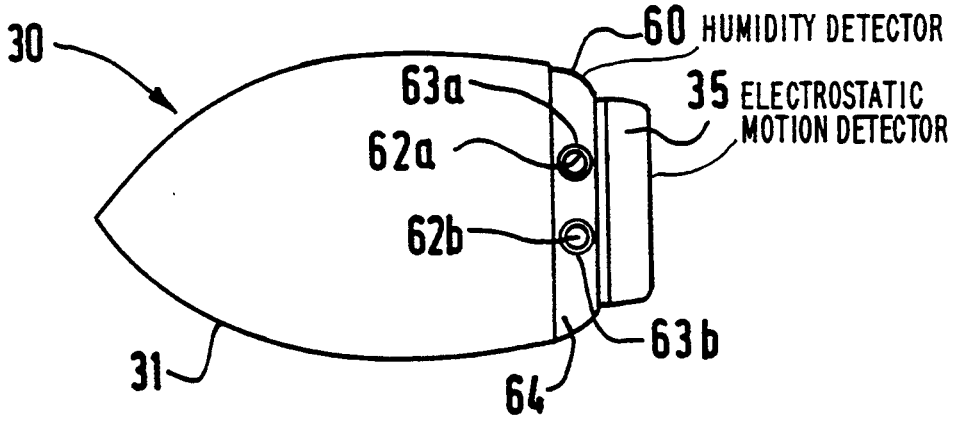
FIG. 3 is a diagrammatic underneath view of an iron provided with a humidity detector and an electrostatic detector.
Figure 5A:
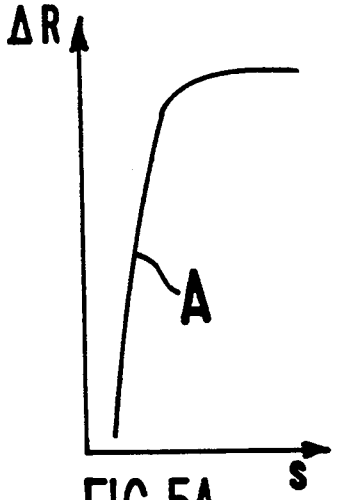
FIGS. 5A and 5B are curves representing the resistance variations DR for cotton and acrylics, respectively, during a drying operation.
Figure 5B:
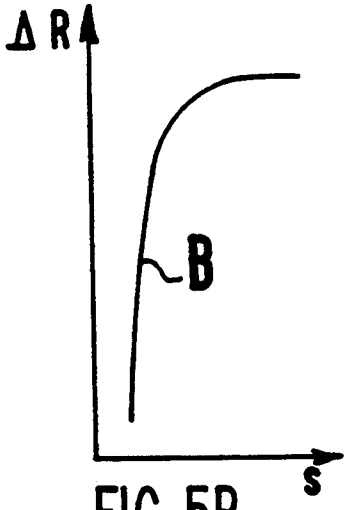
Figure 5C:
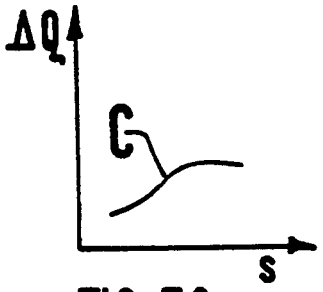
FIGS. 5C and 5D are curves representing the electrostatic charge variations DQ for cotton and acrylics, respectively, during a drying operation.
Figure 5D:
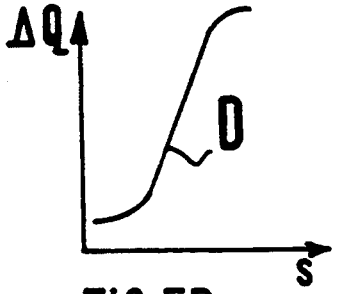

When the degree of humidity of the fabric is too high the generation of electrostatic charges diminishes and may even cease. The rhythm in which the electrostatic charges vary is then measured by means of a humidity detector, which measures the electrical resistance of the fabric between two contact electrodes. Thus, an advantageous embodiment is obtained in that the two detectors are made to operate in a complementary fashion. FIG. 3 is a diagrammatic underneath view of an iron 30 provided with a humidity detector 60 and an electrostatic detector 35. The humidity detector 60 comprises two electrodes 62*a*, 62*b*, which preferably have a rounded shape, for example hemispheric, to slide easily on the fabric. Suitable electrodes are, for example, stainless steel electrodes of 5 mm to 10 mm diameter. These electrodes may be arranged on an elastic base 64 for a good contact with the fabric without leaving any traces. These electrodes are connected to measurement means which determine the rhythm of the variations of the electrical resistance of the fabric. If the electrical resistance is low the fabric is moist. If this resistance value is high the fabric is dry. The electrodes are accommodated in recesses 63*a*, 63*b* formed in the base 64.

When the amount of generated electrostatic charges is to be increased the element to be provided may be constituted by said base 64 in that it is made of an electrically insulating material, for example, Teflon, glass, enamel, Kapton. The temperature resistance of the material of the base should be adequate to enable it to be brought into contact with more or less warm fabrics without degradation of the material. In order to ensure that the electrostatic detector 35 can operate in various directions of movement of the iron the base 64 may partly or wholly surround the measurement electrode 40. A suitable shape is, for example, an L-shape or a circular shape.

Figure 4:
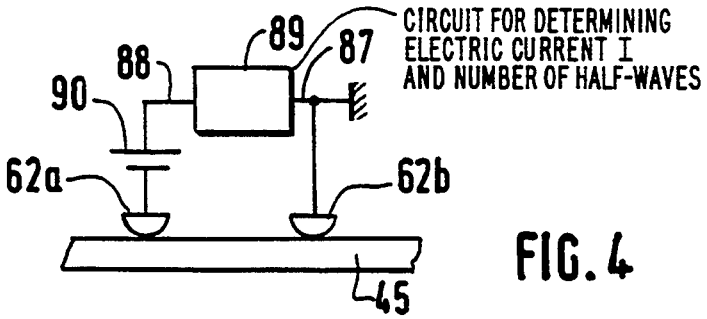
FIG. 4 is a diagram of an electrical resistivity measurement circuit.

FIG. 4 is a diagram of an electrical resistivity-measurement circuit. The electrodes 62*a*, 62*b*, which are in contact with the fabric 45, are connected to an electrical power supply 90 and to a circuit 89 for measuring the electric current I in the circuit.

FIGS. 5A, 5B, 5C and 5D are curves representing resistance variations DR and electrostatic-charge variations DQ during a dehumidifying operation for an iron as shown in FIG. 3. When the iron is applied and subsequently moved in the direction of its front tip with a moderately warm soleplate the humidity detector 60 will meet fabric areas which become increasingly dry (over the soleplate length of the iron). This yields curves A and C for cotton and curves B and C for acrylic fabrics as a function of the degree of drying s. The curves D and D relate to the electrostatic-charge variations DQ. The units which are used are arbitrary. When the resistance becomes high the amount of electrostatic charge increases in relation to the nature of the fabric. In practice, the fabrics never have a constant humidity, which results in fluctuations of the signal as a function of the movements of the iron.

Figure 6:
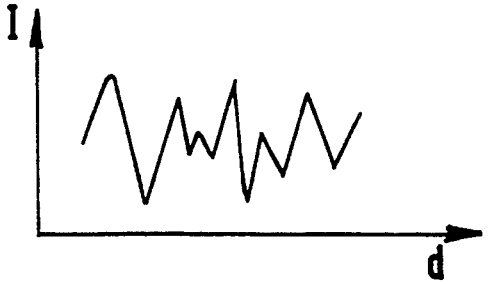
FIG. 6 is an example of a curve representing the variation of an output signal I (d) as a function of the displacement d.

FIG. 6 shows a curve representing the variation of an output signal I (d) as a function of the displacement d of the iron. It is both representative of a signal obtained from the electrostatic detector and from the humidity detector. The signal consists of a sequence of halfwaves of variable amplitudes. To detect the movement the number of rises and/or falls of the signal in a predetermined time interval is calculated. These halfwaves of the signal are caused by the ironing movements.

Figure 7:
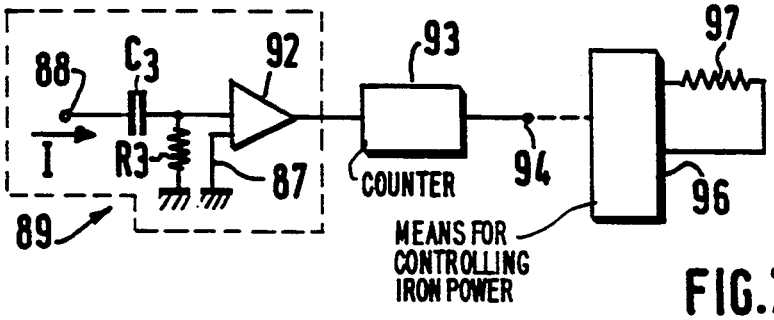
FIG. 7 shows an example of a rhythm measurement circuit.

FIG. 7 shows an example of the circuit 89 by means of which the number of halfwaves can be determined. It comprises a capacitor $C_3$ and a resistor $R_3$ connected to an input of an amplifier 92 having a high input impedance. This circuit derives the signal I and supplies pulses upon each rising and falling edge of the signal. These pulses are subsequently counted in a counter 93, which supplies a signal S on an output 94 when no or a very small number of pulses (for example 1 to 3) have appeared within the predetermined time interval. This signal S is then used to influence the control means 96 of the iron in order to turn off the heating of the heating element 97.

The other input of the amplifier 92 may be connected to earth. The soleplate of the iron can now take the place of the electrode $62_b$. The humidity detector then comprises an electrode $62_a$ and the soleplate 31 as the second electrode.

Figure 8:
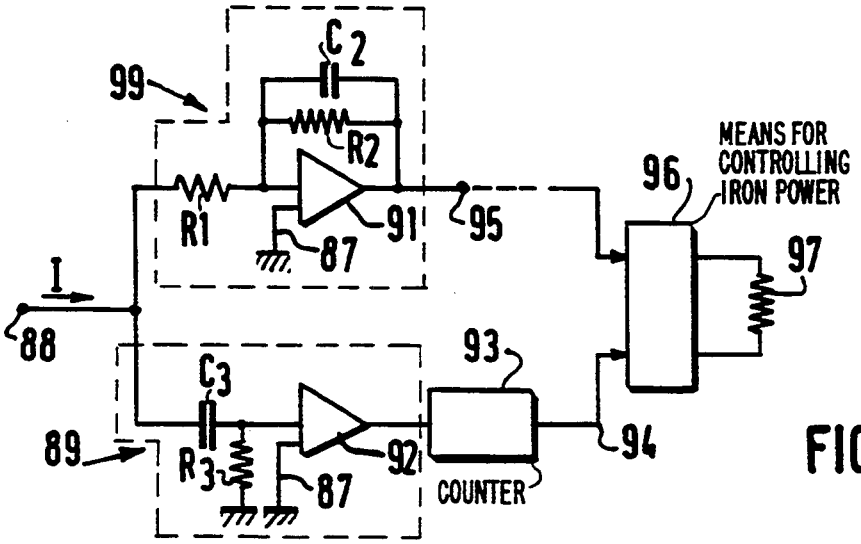
FIG. 8 shows an example of a rhythm and humidity measurement circuit.

It is also possible to extend the circuit 89 with another circuit 99 which determines the average amplitude of the signal I (d). (FIG. 8). This average value is then representative of the degree of humidity of the fabric. The circuit comprises a resistor $R_1$ connected to the input terminal 88 receiving the current I, the other end of this resistor $R_1$ being connected to an amplifier 91 having a high input impedance. A circuit comprising a capacitance $C_2$ and a resistance $R_2$ in parallel is arranged between the input and the output of this amplifier 91. Thus, a signal representing the average degree of humidity of the fabric appears on the output 95. This signal can then be used for influencing the means 96 for controlling the iron, for example in order to increase the electric power dissipated in the heating element 97 in order to speed up the rate of dehumidification of the fabric.

We claim:

1. An iron comprising a heating element (97), heating-control means (96) for the heating element, and a motion detector, wherein the motion detector is an electrostatic detector (35) mounted on said iron for movement therewith comprising:

means (40, 42, 43, 46) for picking up electrostatic charges produced by a movement of the iron on a fabric, and means (41, 89), responsive to signals from said means (40, 42, 43, 46) for picking up electrostatic charges, for detecting the movement of the iron by measuring a rhythm of an electric signal resulting from variations of the electrostatic charges.

2. An iron as claimed in claim 1, wherein the iron comprises an element (64) made of an electrically insulating material and arranged on the iron to generate electrostatic charges by frictional contact as the iron slides on the fabric.

3. An iron as claimed in claim 2, wherein the insulating material is Teflon, glass, enamel, or Kapton.

4. An iron as claimed in claim 3, wherein the element (64) at least partly surrounds the electrostatic detector.

5. An iron as claimed in claim 3, wherein said iron further comprises a humidity detector (60) comprising:

resistivity means (**62*a*, 62*b*) for measuring a resistivity of the fabric, and detecting means (89,90) delivering a further electrical signal through the resistivity means, the detecting means detecting the movement of the iron by measuring a rhythm of the further electrical signal resulting from resistivity variations caused by the movement of the iron on the fabric, said detecting means (89,90) being operatively associated with said heating control means (96) for controlling the heating element in response to the humidity of the fabric as measured by the resistivity means (62*a*, 62*b*) and the detecting means (89,90**).

6. An iron as claimed in claim 3, wherein the detecting means (89) for detecting the movement comprises:

a differentiation circuit for differentiating the electrical signal and delivering differentiation pulses characterizing the electrical signal, and a counter (93) which, during a predetermined time interval, measures a number of pulses appearing on the output of the differentiation circuit, the counter stopping the control means (96) of the iron when the number of differentiation pulses is smaller than a predetermined number.

7. An iron as claimed in claim 2, wherein the element (64) at least partly surrounds the electrostatic detector.

8. An iron as claimed in claim 4, wherein said iron further comprises a humidity detector (60) comprising:

resistivity means (**62*a*, 62*b*) for measuring a resistivity of the fabric, and detecting means (89,90) delivering a further electrical signal through the resistivity means, the detecting means detecting the movement of the iron by measuring a rhythm of the further electrical signal resulting from resistivity variations caused by the movement of the iron on the fabric, said detecting means (89,90) being operatively associated with said heating control means (96) for controlling the heating element in response to the humidity of the fabric as measured by the resistivity means (62*a*, 62*b*) and the detecting means (89,90**).

9. An iron as claimed in claim 4, wherein the detecting means (89) for detecting the movement comprises:

a differentiation circuit for differentiating the electrical signal and delivering differentiation pulses characterizing the electrical signal, and a counter (93) which, during a predetermined time interval, measures a number of pulses appearing on the output of the differentiation circuit, the counter stopping the control means (96) of the iron when the number of differentiation pulses is smaller than a predetermined number.

10. An iron as claimed in claim 2, wherein said iron further comprises a humidity detector (60) comprising:

resistivity means (**62*a*, 62*b*) for measuring a resistivity of the fabric, and detecting means (89,90) delivering a further electrical signal through the resistivity means, the detecting means detecting the movement of the iron by measuring a rhythm of the further electrical signal resulting from resistivity variations caused by the movement of the iron on the fabric, said detecting means (89,90) being operatively associated with said heating control means (96) for controlling the heating element in response to the humidity of the fabric as measured by the resistivity means (62*a*, 62*b*) and the detecting means (89,90**).

11. An iron as claimed in claim 2, wherein the detecting means (89) for detecting the movement comprises:

a differentiation circuit for differentiating the electrical signal and delivering differentiation pulses characterizing the electrical signal, and a counter (93) which, during a predetermined time interval, measures a number of pulses appearing on the output of the differentiation circuit, the counter stopping the control means (96) of the iron when the number of differentiation pulses is smaller than a predetermined, number.

12. An iron as claimed in claim 1, which further comprises a humidity detector (60) comprising:

resistivity means (**62*a*, 62*b*) for measuring a resistivity of the fabric, and detecting means (89,90) delivering a further electrical signal through the resistivity means, the detecting means detecting the movement of the iron by measuring a rhythm of the further electrical signal resulting from resistivity variations caused by the movement of the iron on the fabric, said detecting means (89,90) being operatively associated with said heating control means (96) for controlling the heating element in response to the humidity of the fabric as measured by the resistivity means (62***a*, 62*b*) and the detecting means (89,90).

13. An iron as claimed in claim 12, wherein the means for measuring the resistivity comprise at least one electrode (62*a*), (62*b*) which is flush with the soleplate of the iron to enable it to be brought into contact with the fabric.

14. An iron as claimed in claim 6, wherein the detecting means (89) for detecting the movement comprises:

a differentiation circuit for differentiating the electrical signal, the further electrical signal, and both the electrical signal and the further electrical signal, and delivering differentiation pulses, and a counter (93) which, during a predetermined time interval, measures a number of pulses appearing on the output of the differentiation circuit, the counter stopping the control means (96) of the iron when the number of differentiation pulses is smaller than a predetermined number.

15. An iron as claimed in claim 6, wherein the humidity detector in addition detects an average degree of humidity of the fabric with the aid of means (99) which measure an average amplitude of said further electric signal.

16. An iron as claimed in claim 5, wherein the detecting means (89) for detecting the movement comprises:

a differentiation circuit for differentiating the electrical signal, the further electrical signal, and both the electrical signal and the further electrical signal, and delivering differentiation pulses, and a counter (93) which, during a predetermined time interval, measures a number of pulses appearing on the output of the differentiation circuit, the counter stopping the control means (96) of the iron when the number of differentiation pulses is smaller than a predetermined number.

17. An iron as claimed in claim 5, wherein the humidity detector in addition detects an average degree of humidity of the fabric with the aid of means (99) which measure an average amplitude of said further electric signal.

18. An iron as claimed in claim 1 wherein the detecting means (89) for detecting the movement comprises:

a differentiation circuit for differentiating the electrical signal and delivering differentiation pulses characterizing the electrical signal, and a counter (93) which, during a predetermined time interval, measures a number of pulses appearing on the output of the differentiation circuit, the counter stopping the control means (96) of the iron when the number of differentiation pulses is smaller than a predetermined number.

19. An iron as claimed in claim 7, wherein the humidity detector in addition detects an average degree of humidity of the fabric with the aid of means (99) which measure an average amplitude of said further electric signal.

20. An iron as claimed in claim 5, wherein the humidity detector is operatively associated with said heating control means (96) and in addition detects an average degree of humidity of the fabric with the aid of means (99) which measure an average amplitude of said further electric signal.

* * * * *